US007045262B2

(12) United States Patent
Tong et al.

(10) Patent No.: US 7,045,262 B2
(45) Date of Patent: May 16, 2006

(54) PHOTOCONDUCTIVE IMAGING MEMBERS

(75) Inventors: Yuhua Tong, Webster, NY (US); Satchidanand Mishra, Webster, NY (US); Anthony M. Horgan, Pittsford, NY (US); John F. Yanus, Webster, NY (US); Dale S. Renfer, Webster, NY (US); Robert C. U. Yu, Webster, NY (US); Markus R. Silvestri, Fairport, NY (US); Cindy C. Chen, Rochester, NY (US); Lanhui Zhang, Webster, NY (US)

(73) Assignee: Xerox Corporation, Stamford, CT (US)

( * ) Notice: Subject to any disclaimer, the term of this patent is extended or adjusted under 35 U.S.C. 154(b) by 154 days.

(21) Appl. No.: 10/762,669

(22) Filed: Jan. 22, 2004

(65) Prior Publication Data

US 2005/0164104 A1 Jul. 28, 2005

(51) Int. Cl.
*G03G 15/02* (2006.01)

(52) U.S. Cl. ..... 430/58.05; 430/59.6; 430/64; 430/58.8; 430/59.4

(58) Field of Classification Search ..... 430/58.05, 430/59.6, 64, 58.8, 59.4
See application file for complete search history.

(56) References Cited

U.S. PATENT DOCUMENTS

| | | | | |
|---|---|---|---|---|
| 4,265,990 | A | 5/1981 | Stolka et al. | 430/59 |
| 4,477,547 | A | 10/1984 | Yamada et al. | |
| 4,555,463 | A | 11/1985 | Hor et al. | 430/59 |
| 4,559,285 | A | 12/1985 | Hoffmann et al. | |
| 4,587,189 | A | 5/1986 | Hor et al. | 430/59 |
| 4,921,769 | A | 5/1990 | Yuh et al. | 430/64 |
| 5,069,991 | A * | 12/1991 | Leyrer et al. | 430/49 |
| 5,473,064 | A | 12/1995 | Mayo et al. | 540/141 |
| 5,482,811 | A | 1/1996 | Keoshkerian et al. | 430/135 |
| 5,521,043 | A | 5/1996 | Listigovers et al. | 430/59 |
| 5,681,678 | A | 10/1997 | Nealey et al. | |
| 5,725,985 | A | 3/1998 | Nealey et al. | |
| 6,015,645 | A | 1/2000 | Murti et al. | 430/59 |
| 6,156,468 | A | 12/2000 | Wehelie et al. | 430/65 |
| 6,177,219 | B1 | 1/2001 | Yuh et al. | 430/65 |
| 6,255,027 | B1 | 7/2001 | Wehelie et al. | 430/65 |
| 6,287,737 | B1 | 9/2001 | Ong et al. | 430/58.8 |

OTHER PUBLICATIONS

Patent Abstracts of Japan, vol. 018, No. 284 (P-1745), May 30, 1994 and JP 06 051546 A, Ricoh Company, Ltd., Feb. 25, 1994 (Abstract).

Database WPI, Section Ch, Week 199416, Derwent Publications Ltd., AN 1994-129215 XP002325234 & JP 06075387 A, Ricoh KK, Mar. 18, 1994 (Abstract).

Patent Abstracts of Japan, vol. 009, No. 020 (P-330), Jan. 26, 1985 & JP 59 166969 A, Mitsubishi Seishi KK, Sep. 20, 1984 (Abstract).

Database WPI, Section CH, Week 198948, Derwent Publications Ltd., AN 1989-351549 XP002325398 & JP 01 261659 A, Mitsubishi Paper Mills Ltd., Oct. 18, 1989 (Abstract).

* cited by examiner

*Primary Examiner*—Mark A. Chapman
(74) *Attorney, Agent, or Firm*—E. O. Palazzo

(57) ABSTRACT

A photoconductive imaging member comprised of a photogenerating layer and a charge transport layer, and wherein the charge transport layer contains a polymeric solid acid.

42 Claims, No Drawings

PHOTOCONDUCTIVE IMAGING MEMBERS

CROSS REFERENCE

There is illustrated in copending U.S. Ser. No. 10/369,816, entitled Photoconductive Imaging Members, filed Feb. 19, 2003, now U.S. Pat. No. 6,913,863, the disclosure of which is totally incorporated herein by reference, a photoconductive imaging member comprised of a hole blocking layer, a photogenerating layer, and a charge transport layer, and wherein the hole blocking layer is comprised of a metal oxide, and a mixture of a phenolic compound and a phenolic resin wherein the phenolic compound contains at least two phenolic groups.

There is illustrated in copending U.S. Ser. No. 10/370,186, entitled Photoconductive Imaging Members, filed Feb. 19, 2003, now U.S. Publication No. 20040161683, the disclosure of which is totally incorporated herein by reference, a photoconductive imaging member comprised of a supporting substrate, a hole blocking layer thereover, a crosslinked photogenerating layer and a charge transport layer, and wherein the photogenerating layer is comprised of a photogenerating component and a vinyl chloride, allyl glycidyl ether, hydroxy containing polymer.

There is illustrated in copending U.S. Ser. No. 10/369,798, entitled Photoconduotive Imaging Members, filed Feb. 19, 2003, now U.S. Pat. No. 6,875,548, the disclosure of which is totally incorporated herein by reference, a photoconductive imaging member comprised of an optional supporting substrate, a photogenerating layer, and a charge transport layer, and wherein the charge transport layer is comprised of a charge transport component and a polysiloxane.

There is illustrated in copending U.S. Ser. No. 10/369,812, entitled Photoconductive Imaging Members, filed Feb. 19, 2003, now U.S. Pat. No. 6,824,940, the disclosure of which is totally incorporated herein by reference, a photoconductive imaging member containing a hole blocking layer, a photogenerating layer, a charge transport layer, and thereover an overcoat layer comprised of a polymer with a low dielectric constant and charge transport molecules.

The appropriate components and processes of the above copending applications, inclusive of the photogenerating components, the charge transport components, such as the hole transport components modified as illustrated hereinafter, the blocking layers, the adhesive layers can be selected for the present invention in embodiments thereof.

RELATED PATENTS

Illustrated in U.S. Pat. No. 6,015,645, the disclosure of which is totally incorporated herein by reference, is a photoconductive imaging member comprised of a supporting substrate, a hole blocking layer, an optional adhesive layer, a photogenerator layer, and a charge transport layer, and wherein the blocking layer is comprised, for example, of a polyhaloalkylstyrene.

Illustrated in U.S. Pat. No. 6,287,737, the disclosure of which is totally incorporated herein by reference, is a photoconductive imaging member comprised of a supporting substrate, a hole blocking layer thereover, a photogenerating layer and a charge transport layer, and wherein the hole blocking layer is comprised of a crosslinked polymer derived from the reaction of a silyl-functionalized hydroxyalkyl polymer of Formula (I) with an organosilane of Formula (II) and water

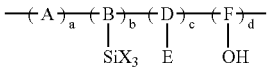

(I)

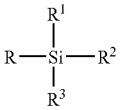

(II)

wherein A, B, D, and F represent the segments of the polymer backbone; E is an electron transporting moiety; X is selected from the group consisting of halide, cyano, alkoxy, acyloxy, and aryloxy; a, b, c, and d are mole fractions of the repeating monomer units such that the sum of a+b+c+d is equal to 1; R is alkyl, substituted alkyl, aryl, or substituted aryl; and $R^1$, $R^2$, and $R^3$ are independently selected from the group consisting of alkyl, aryl, alkoxy, aryloxy, acyloxy, halogen, cyano, and amino, subject to the provision that two of $R^1$, $R^2$, and $R^3$ are independently selected from the group consisting of alkoxy, aryloxy, acyloxy, and halide.

Illustrated in U.S. Pat. No. 5,473,064, the disclosure of which is totally incorporated herein by reference, is a process for the preparation of hydroxygallium phthalocyanine Type V, essentially free of chlorine, whereby a pigment precursor Type I chlorogallium phthalocyanine is prepared by reaction of gallium chloride in a solvent, such as N-methylpyrrolidone, present in an amount of from about 10 parts to about 100 parts, and preferably about 19 parts with 1,3-diiminoisoindolene ($DI^3$) in an amount of from about 1 part to about 10 parts, and preferably about 4 parts $DI^3$, for each part of gallium chloride that is reacted; hydrolyzing the pigment precursor chlorogallium phthalocyanine Type I by standard methods, for example acid pasting, whereby the pigment precursor is dissolved in concentrated sulfuric acid and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts, and preferably about 15 volume parts for each weight part of pigment hydroxygallium phthalocyanine that is used by, for example, ballmilling the Type I hydroxygallium phthalocyanine pigment in the presence of spherical glass beads, approximately 1 millimeter to 5 millimeters in diameter, at room temperature, about 25° C., for a period of from about 12 hours to about 1 week, and preferably about 24 hours.

Illustrated in U.S. Pat. No. 5,521,043, the disclosure of which is totally incorporated herein by reference, are photoconductive imaging members comprised of a supporting substrate, a photogenerating layer of hydroxygallium phthalocyanine, a charge transport layer, a photogenerating layer of BZP perylene, which is preferably a mixture of bisbenzimidazo(2,1-a-1',2'-b)anthra(2,1,9-def:6,5,10-d'e'f')diisoquinoline-6,11-dione and bisbenzimidazo(2,1-a:2',1'-a)anthra(2,1,9-def:6,5,10-d'e'f')diisoquinoline-10,21-dione, reference U.S. Pat. No. 4,587,189, the disclosure of which is totally incorporated herein by reference; and as a top layer a second charge transport layer.

The appropriate components and processes of the above patents may be selected for the present invention in embodiments thereof.

BACKGROUND

This invention is generally directed to imaging members, and more specifically, the present invention is directed to single and multi-layered photoconductive imaging members with a hole blocking layer, which is typically a thin crosslinked silane coating, or an undercoat layer (UCL) comprised of, for example, a metal oxide, such as titanium oxide dispersed in a phenolic resin/phenolic resin blend or a phenolic resin/phenolic compound blend, and which layer can be deposited on a supporting substrate; a charge generation layer and a charge transport layer which contains a polymeric acid or a copolymer solid acid. In embodiments the photoconductive imaging members can be in a number of different forms, such as in a rigid form, a drum configuration, a web, a flexible belt configuration, which may be seamed or seamless, and the like. More specifically, for the multi-layered photoconductive imaging members, the hole blocking layer in contact with the supporting substrate can be situated between the supporting substrate and the photogenerating layer, which is comprised, for example, of the photogenerating pigments of U.S. Pat. No. 5,482,811, the disclosure of which is totally incorporated herein by reference, especially Type V hydroxygallium phthalocyanine, and generally metal free phthalocyanines, metal phthalocyanines, perylenes, titanyl phthalocyanines, selenium, selenium alloys, azo pigments, squaraines, and the like. The charge transport layer comprised of charge transport materials and binders is doped by solid acids to achieve high application performance.

The imaging members of the present invention in embodiments exhibit excellent photosensitivity; desirable low dark decay characteristics; steep photo induced discharge curves; low discharge residuals and substantially little or no cycle up is needed; cyclic/environmental stability; low and excellent $V_{low}$, that is the surface potential of the imaging member subsequent to a certain light exposure, and which $V_{low}$ is about 25 to about 100 volts lower than, for example, a comparable imaging member; low depletion potentials; high photoinduced discharge curve sensitivity. The photoresponsive, or photoconductive imaging members can be negatively charged when the photogenerating layers are situated between the charge transport layer and the hole blocking layer deposited on the substrate.

Processes of imaging, especially xerographic imaging and printing, including digital, are also encompassed by the present invention. More specifically, the layered photoconductive imaging members of the present invention can be selected for a number of different known imaging and printing processes including, for example, electrophotographic imaging processes, especially xerographic imaging and printing processes wherein charged latent images are rendered visible with toner compositions of an appropriate charge polarity. The imaging members are in embodiments sensitive in the wavelength region of, for example, from about 500 to about 900 nanometers, and in particular from about 650 to about 850 nanometers, thus diode lasers can be selected as the light source. Moreover, the imaging members of this invention are useful in color xerographic applications, particularly high-speed color copying and printing processes.

REFERENCES

Layered photoresponsive imaging members have been described in numerous U.S. patents, such as U.S. Pat. No. 4,265,990, the disclosure of which is totally incorporated herein by reference, wherein there is illustrated an imaging member comprised of a photogenerating layer, and an aryl amine hole transport layer. Examples of photogenerating layer components include trigonal selenium, metal phthalocyanines, vanadyl phthalocyanines, and metal free phthalocyanines. Additionally, there is described in U.S. Pat. No. 3,121,006, the disclosure of which is totally incorporated herein by reference, a composite xerographic photoconductive member comprised of finely divided particles of a photoconductive inorganic compound dispersed in an electrically insulating organic resin binder.

The uses of perylene pigments as photoconductive substances are also known. There is thus described in Hoechst European Patent Publication 0040402, DE3019326, filed May 21, 1980, the use of N,N'-disubstituted perylene-3,4,9,10-tetracarboxyldiimide pigments as photoconductive substances. Specifically, there is, for example, disclosed in this publication N,N'-bis(3-methoxypropyl)perylene-3,4,9,10-tetracarboxyl-diimide dual layered negatively charged photoreceptors with improved spectral response in the wavelength region of 400 to 700 nanometers. A similar disclosure is presented in Ernst Gunther Schlosser, *Journal of Applied Photographic Engineering*, Vol. 4, No. 3, page 118 (1978). There are also disclosed in U.S. Pat. No. 3,871,882, the disclosure of which is totally incorporated herein by reference, photoconductive substances comprised of specific perylene-3,4,9,10-tetracarboxylic acid derivative dyestuffs. In accordance with this patent, the photoconductive layer is preferably formed by vapor depositing the dyestuff in a vacuum. Also, there are disclosed in this patent dual layer photoreceptors with perylene-3,4,9,10-tetracarboxylic acid diimide derivatives, which have spectral response in the wavelength region of from 400 to 600 nanometers. Further, in U.S. Pat. No. 4,555,463, the disclosure of which is totally incorporated herein by reference, there is illustrated a layered imaging member with a chloroindium phthalocyanine photogenerating layer. In U.S. Pat. No. 4,587,189, the disclosure of which is totally incorporated herein by reference, there is illustrated a layered imaging member with, for example, a perylene, pigment photogenerating component. Both of the aforementioned patents disclose an aryl amine component, such as N,N'-diphenyl-N,N'-bis(3-methyl phenyl)-1,1'-biphenyl-4,4'-diamine dispersed in a polycarbonate binder as a hole transport layer. The above components, such as the photogenerating compounds and the aryl amine charge transport, can be selected for the imaging members of the present invention in embodiments thereof.

In U.S. Pat. No. 4,921,769, the disclosure of which is totally incorporated herein by reference, there are illustrated photoconductive imaging members with blocking layers of certain polyurethanes.

Illustrated in U.S. Pat. Nos. 6,255,027; 6,177,219, and 6,156,468, the disclosures of which are totally incorporated herein by reference, are, for example, photoreceptors containing a hole blocking layer of a plurality of light scattering particles dispersed in a binder, reference for example, Example I of U.S. Pat. No. 6,156,468, the disclosure of which is totally incorporated herein by reference, wherein there is illustrated a hole blocking layer of titanium dioxide dispersed in a specific linear phenolic binder of VARCUM™, available from OxyChem Company.

Also known are photoconductive imaging members wherein the charge transport layer thereof is doped with a trifluoroacetic acid to provide photoelectrical function enhancement, but unfortunately which acid can vaporize, and may possess toxic characteristics. However, the aforementioned disadvantages are effectively avoided/minimized with the imaging members of the present invention.

SUMMARY

It is a feature of the present invention to provide imaging members with many of the advantages illustrated herein, and where there is selected for addition to the charge transport layer a solid acid as a doping component.

Another feature of the present invention relates to the provision of layered photoresponsive imaging members, which are responsive to near infrared radiation of from about 700 to about 900 nanometers.

It is yet another feature of the present invention to provide layered photoresponsive imaging members with sensitivity to visible light.

Moreover, another feature of the present invention relates to the provision of layered photoresponsive imaging members with mechanically robust and solvent resistant hole blocking layers.

In a further feature of the present invention there are provided imaging members containing hole blocking polymer layers comprised of titanium oxide and a phenolic compound/phenolic resin blend, or a low molecular weight phenolic resin/phenolic resin blend, and which phenolic compounds containing at least two, and more specifically, two to ten phenolic groups or low molecular weight phenolic resins with a weight average molecular weight ranging from about 500 to about 2,000, and which components can interact with and consume formaldehyde and other phenolic precursors within the phenolic resin effectively, thereby chemically modifying the curing processes for such resins and permitting, for example, a hole blocking layer with excellent efficient electron transport, and which usually results in a desirable lower residual potential and $V_{low}$.

Moreover, in another feature of the present invention there is provided a hole blocking layer comprised of titanium oxide, a phenolic resin/phenolic compound(s) blend or phenolic resin(s)/phenolic resin blend comprised of a first linear, or a first nonlinear phenolic resin, and a second phenolic resin or phenolic compounds containing at least about 2, such as about 2, about 2 to about 12, about 2 to about 10, about 3 to about 8, about 4 to about 7, and the like, phenolic groups, and which blocking layer is applied to a drum of, for example, aluminum, and cured at a high temperature of, for example, from about 135° C. to about 165° C.

Aspects of the present invention relate to a photoconductive imaging member comprised of a photogenerating layer and a charge transport layer, and wherein the charge transport layer contains a polymeric solid acid; a member comprised of a supporting substrate a photogenerating layer, and a charge transport layer, and wherein the charge transport layer contains a copolymeric solid acid; a photoconductive imaging member comprised of a supporting substrate, an optional hole blocking layer, a photogenerating layer, and a charge transport layer, and wherein the charge transport layer contains a polymeric solid acid of poly(ethylene-co-acrylic acid), poly(ethylene-co-methacrylic acid), poly(1,6-hexanedio/neopentyl glycol-alt-adipic acid), poly(3-hydroxybutyric acid), poly(3-hydroxybutyric-co-3-hydroxyvaleic acid), poly(4-hydroxy benzoic acid-co-ethylene terephthalate), poly(methyl methacrylate-co-methacrylic acid), poly(methyl vinyl ether-alt-maleic acid), poly(styrene-co-maleic acid)ester, poly(vinyl chloride-co-vinyl acetate-co-maleic acid), or poly(vinyl chloride-co-vinyl acetate-co-2-hydroxypropyl acrylate-co-maleic acid); a photoconductive imaging member wherein the hole blocking layer is of a thickness of about 0.01 to about 30 microns, and more specifically, is of a thickness of about 1 to about 8 microns; a photoconductive imaging member comprised in sequence of a supporting substrate, a hole blocking layer, an adhesive layer, a photogenerating layer and a charge transport layer; a photoconductive imaging member wherein the supporting substrate is comprised of a conductive metal substrate; a photoconductive imaging member wherein the conductive substrate is aluminum, aluminized polyethylene terephthalate or titanized polyethylene terephthalate, or titanized polyethylene naphthalate; a photoconductive imaging member wherein the photogenerator layer is of a thickness of from about 0.05 to about 10 microns; a photoconductive imaging member wherein the charge, such as hole transport layer, is of a thickness of from about 10 to about 50 microns; a photoconductive imaging member wherein the photogenerating layer is comprised of photogenerating pigments dispersed in a resinous binder in an amount of from about 5 percent by weight to about 95 percent by weight; a photoconductive imaging member wherein the photogenerating resinous binder is selected from the group consisting of copolymers of vinyl chloride, vinyl acetate and hydroxy and/or acid containing monomers, polyesters, polyvinyl butyrals, polycarbonates, polystyrene-b-polyvinyl pyridine, and polyvinyl formals; a photoconductive imaging member wherein the charge transport layer comprises aryl amine molecules and resinous binder; a photoconductive imaging member wherein the charge transport aryl amines are of the formula

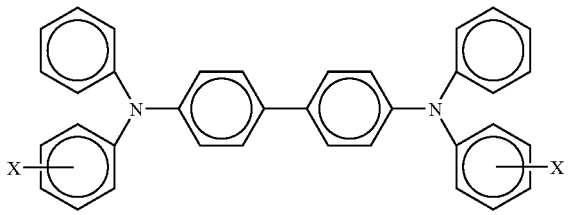

wherein X is selected from the group consisting of alkyl, alkoxy, and halogen, and wherein the aryl amine is dispersed in a resinous binder; a photoconductive imaging member wherein the aryl amine alkyl is methyl, wherein halogen is chloride, and wherein the resinous binder is selected from the group consisting of polycarbonates and polystyrene; a photoconductive imaging member wherein the aryl amine is N,N'-diphenyl-N,N-bis(3-methyl phenyl)-1,1'-biphenyl-4,4'-diamine; a photoconductive imaging member wherein the photogenerating layer is comprised of metal phthalocyanines, or metal free phthalocyanines; a photoconductive imaging member wherein the photogenerating layer is comprised of titanyl phthalocyanines, perylenes, alkylhydroxygallium phthalocyanines, hydroxygallium phthalocyanines, or a mixture thereof; a photoconductive imaging member wherein the photogenerating layer is comprised of Type V hydroxygallium phthalocyanine; a method of imaging which comprises generating an electrostatic latent image on the imaging member illustrated herein, developing the latent image, and transferring the developed electrostatic image to a suitable substrate; an imaging member wherein the hole blocking layer phenolic compound is bisphenol S, 4,4'-sulfonyldiphenol; an imaging member wherein the phenolic compound is bisphenol A, 4,4'-isopropylidenediphenol; an imaging member wherein the phenolic compound is bisphenol E, 4,4'-ethylidenebisphenol; an imaging member wherein the phenolic compound is bisphenol F, bis(4-hydroxyphenyl)methane; an imaging member wherein the phenolic compound is bisphenol M, 4,4'-(1,3-phenylenediisopropylidene)bisphenol; an imaging member wherein the phenolic compound is bisphenol P, 4,4'-(1,4-phenylenediisopropylidene) bisphenol; an imaging member wherein the phenolic compound is bisphenol Z, 4,4'-cyclohexylidenebisphenol; an imaging member wherein the phenolic compound is hexafluorobisphenol A, 4,4'-(hexafluoroisopropylidene) diphenol; an imaging member wherein the phenolic compound is resorcinol, 1,3-benzenediol; an imaging member wherein the phenolic compound is hydroxyquinone, 1,4-benzenediol; an imaging member wherein the phenolic compound is of the formula

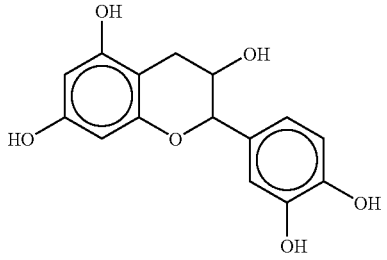

Catechin an imaging member wherein the blocking layer comprises from about 1 to about 99 weight percent of a first phenolic resin and from about 99 to about 1 weight percent of a second phenolic resin, and wherein the total thereof is about 100 percent; an imaging member wherein the hole blocking layer is of a thickness of about 0.5 to about 25 microns; an imaging member comprised in the sequence of a supporting substrate, a hole blocking layer, an adhesive layer, a photogenerating layer, and a solid acid doped charge or hole transport layer; an imaging member wherein the adhesive layer is comprised of a polyester with an $M_w$ of about 45,000 to about 75,000, and an $M_n$ of from about 30,000 about 40,000; an imaging member wherein the photogenerator layer is of a thickness of from about 2 to about 10 microns, and wherein the charge transport layer is of a thickness of from about 15 to about 75 microns; an imaging member wherein the photogenerating layer is comprised of photogenerating pigments dispersed in a resinous binder in an amount of from about 10 percent by weight to about 90 percent by weight, and optionally wherein the resinous binder is selected from the group comprised of vinyl chloride/vinyl acetate copolymers, polyesters, polyvinyl butyrals, polycarbonates, polystyrene-b-polyvinyl pyridine, and polyvinyl formals; an imaging member wherein the charge transport layer comprises a resinous binder and suitable known or future developed charge transport components, and more specifically aryl amines, and which aryl amines are of the formula

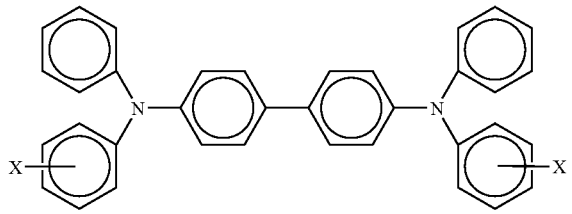

wherein X is selected from the group consisting of alkyl with from 1 to about 12 carbon atoms, alkoxy with from about 1 to about 10 carbon atoms, and halogen, and the like, and wherein the aryl amine is optionally dispersed in a resinous binder; an imaging member wherein the aryl amine is N,N'-diphenyl-N,N-bis(3-methyl phenyl)-1,1'-biphenyl-4,4'-diamine; an imaging member wherein the photogenerating layer is comprised of pigments of metal phthalocyanines, metal free phthalocyanines, or mixtures thereof; an imaging member wherein the photogenerating layer is comprised of titanyl phthalocyanines, perylenes, or hydroxygallium phthalocyanines; an imaging member wherein the photogenerating layer is comprised of Type V hydroxygallium phthalocyanine; an imaging member containing a charge transport layer or a plurality of charge transport layers including therein a solid acid, examples of which are of the formula recited herein wherein the carboxylic acid present in the polymer is minimal, such as for example, from about 0.01 to about 20, and more specifically, from about 0.05 to about 10 weight percent and the like, such as solid acids available from Union Carbide like UCARMAG 527® of the following formula

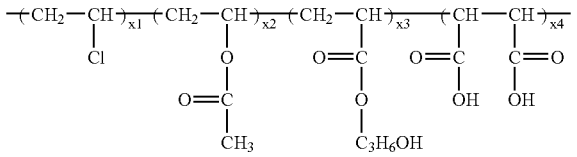

where $x_1$, $X_2$, $X_3$ and $X_4$ represent the molar percentage of each respective component in the polymer, and the sum of $x_1+X_2+x_3+X_4$ is 1; a photoconductive imaging member comprised of a supporting substrate, a hole blocking layer thereover, a photogenerating layer and a charge transport layer comprised of charge transport components and a solid acid copolymer dopant molecularly dispersed or dissolved in a polymer binder, which dopant in embodiments is present in an amount of from about 0.01 to about 20 percent by weight, and more specifically, from about 0.05 to about 10 percent by weight; a photoconductive imaging member comprised of a supporting substrate, a hole blocking layer thereover, an adhesive layer, a photogenerating layer, and a charge transport layer, and wherein the charge transport layer contains a solid acid, such as the know acids available from Union Carbide, such as UCARMAG 527R of the following formula

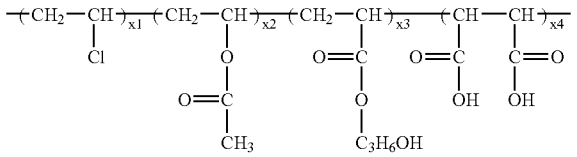

wherein the molar percentage sum of $x_1$, $x_2$, $x_3$ and $x_4$ is about 1; imaging members containing a solid acid thereby permitting excellent and substantially stable photoelectrical; an imaging member containing a layer on the back of a flexible supporting substrate, particularly when the substrate is a flexible organic polymeric material, wherein the added layer can be an anticurl backing layer, such as for example a polycarbonate commercially available as MAKROLON®, to, for example, counteract curling and provide the desired imaging member belt flatness.

Illustrative examples of supporting substrate layers selected for the imaging members of the present invention, and which substrates can be opaque or substantially transparent, comprise a layer of insulating material including metallic, inorganic or organic polymeric materials, such as MYLAR® a commercially available polyethylene terephthalate polymer in the form of a flexible web or belt, MYLAR® is provided with a conductive titanium surface, or a layer of an organic or inorganic material having a semiconductive surface layer, such as indium tin oxide, or aluminum arranged thereon, or a conductive material inclusive of aluminum, chromium, nickel, brass or the like. The substrate may be flexible, seamless, rigid, or other suitable forms, and may have a number of many different configurations, such as for example, a plate, a cylindrical drum, a scroll, an endless flexible seamed belt, and the like. In one embodiment, the substrate is in the form of a seamless flexible belt. The thickness of the substrate layer depends on many factors, including economical considerations, thus this layer may be of substantial thickness, for example over 3,000 microns, or such as from about 400 to about 700 microns used generally for rigid imaging members fabrication. Otherwise, the substrate may be of minimum thickness for flexibility provided there are no significant adverse effects on the resulting flexible imaging member. In embodiments, the thickness of this substrate layer is from about 75 microns to about 300 microns for fabrication of flexible imaging member belts.

The hole blocking layer when present can be applied directly over the conductive surface of the substrate, and wherein the hole blocking layer can be comprised of a number of suitable components, such as a crosslinked gamma amino propyl triethoxy silane having a thickness of about 0.01 micron and about 0.2 micron; a metal oxide dispersed in a blend of a phenolic compound and a phenolic resin, or a blend of two phenolic resins wherein the first resin possesses a weight average molecular weight of from about 500 to about 2,000, and the second resin possesses a weight average molecular weight of from about 2,000 to about 20,000. Further examples of hole blocking layer components are titanium oxide, a dopant, such as a silicon oxide, a phenolic compound or compounds containing at least 2, preferably about 2 to about 10 phenolic groups, such as bisphenol S and/or a phenolic resin having a weight average molecular weight of from about 500 to about 2,000, and a known phenolic resin, reference for example U.S. Pat. No. 6,177,219, the disclosure of which is totally incorporated herein by reference.

The hole blocking layer is, for example, comprised of the components illustrated herein, and more specifically, from about 20 weight percent to about 80 weight percent, from about 55 weight percent to about 65 weight percent of a metal oxide, such as $TiO_2$, from about 20 weight percent to about 70 weight percent, more specifically, from about 25 weight percent to about 50 weight percent of a phenolic resin, from about 2 weight percent to about 20 weight percent, more specifically, from about 5 weight percent to about 15 weight percent of a phenolic compound preferably containing at least two phenolic groups, such as bisphenol S, and from about 2 weight percent to about 15 weight percent, more specifically, from about 4 weight percent to about 10 weight percent of a plywood suppression dopant, such as $SiO_2$. The hole blocking layer coating dispersion can, for example, be prepared as follows. The metal oxide/phenolic resin dispersion is first prepared by ball milling or dynomilling until the median particle size of the metal oxide in the dispersion is less than about 10 nanometers, for example from about 5 to about 9. To the above dispersion, a phenolic compound and dopant are added followed by mixing. The hole blocking layer coating dispersion can be applied by dip coating or web coating, and the layer can be thermally cured after coating. The hole blocking layer resulting is, for example, of a thickness of from about 0.01 micron to about 30 microns, and more specifically, from about 0.1 micron to about 8 microns. Examples of phenolic resins include formaldehyde polymers with phenol, p-tert-butylphenol, cresol, such as VARCUM™ 29159 and 29101 (OxyChem Company) and DURITE™ 97 (Borden Chemical), formaldehyde polymers with ammonia, cresol and phenol, such as VARCUM™ 29112 (OxyChem Company), formaldehyde polymers with 4,4'-(1-methylethylidene)bisphenol, such as VARCUM™ 29108 and 29116 (OxyChem Company), formaldehyde polymers with cresol and phenol, such as VARCUM™ 29457 (OxyChem Company), DURITE™ SD-423A, SD-422A (Borden Chemical), or formaldehyde polymers with phenol and p-tert-butylphenol, such as DURITE™ ESD 556C (Border Chemical).

Examples of specific solid polymeric acids are poly (ethylene-co-acrylic acid), poly(ethylene-co-methacrylic acid), poly(1,6-hexanedio/neopentyl glycol-alt-adipic acid), poly(3-hydroxybutyric acid), poly(3-hydroxybutyric-co-3-hydroxyvaleic acid), poly(4-hydroxy benzoic acid-co-ethylene terephthalate), poly(methyl methacrylate-co-methacrylic acid), poly(methyl vinyl ether-alt-maleic acid), poly (styrene-co-maleic acid)ester, poly(vinyl chloride-co-vinyl acetate-co-maleic acid) (VMCH®), or poly(vinyl chloride-co-vinyl acetate-co-2-hydroxypropyl acrylate-co-maleic acid) with a $M_w$ of, for example, from about 500 to about 100,000, a $M_n$ of from about 300 to about 90,000, and yet more specifically, a $M_w$ of from about 1,000 to about 50,000 and a $M_n$ of from about 800 to about 40,000. The amount of the solid acid present in the charge transport layer is, for example, from about 0.01 to about 20 percent by weight, and more specifically, from about 0.1 to about 5 percent by weight.

The charge transport layer in addition to containing charge transport components, resin binder and a solid acid may also include an antioxidant such as pentaerythritol tetrakis(3-(3,5-di-tert-butyl-4-hydroxyphenyl)propionate) (IRGANOX™ 1010) in an amount of, for example, from about 1 to about 15 weight percent based on the total weight of the layer components. In embodiments, the charge transport layer may comprise a dual layer of a thickness of from about 10 to about 50 with each layer or one layer containing a solid acid dopant and the antioxidant in both layers; alternatively, the solid acid and antioxidant may be present only in the top charge transport layer. About 0.0001 to about 10 microns size inorganic or organic fillers may also be added to the top charge transport layer to achieve filler reinforcement to provide excellent wear resistance, examples of fillers being silica, metal oxides, silicates, TEFLON®, stearates, waxy polyethylene particles, salts of fatty acids, and the like, and/or an overcoat protective layer can be utilized to improve resistance of the photoreceptor to abrasion. In embodiments, an anticurl backing layer may be applied to the surface of the substrate opposite to that bearing the photoconductive layer to provide flatness and/or abrasion resistance where a web configuration photoreceptor is fabricated.

The photogenerating layer, which can, for example, be comprised of hydroxygallium phthalocyanine Type V, is in embodiments comprised of, for example, about 60 weight percent of Type V and about 40 weight percent of a resin binder like polyvinylchloride vinylacetate copolymer such as VMCH (Dow Chemical). The photogenerating layer can contain known photogenerating pigments, such as metal phthalocyanines, metal free phthalocyanines, alkylhydroxyl gallium phthalocyanine, hydroxygallium phthalocyanines, perylenes, especially bis(benzimidazo)perylene, titanyl phthalocyanines, and the like, and more specifically, vanadyl phthalocyanines, Type V hydroxygallium phthalocyanines, and inorganic components such as selenium, selenium alloys, and trigonal selenium. The photogenerating pigment can be dispersed in a resin binder similar to the resin binders selected for the charge transport layer, or alternatively no resin binder is present. Generally, the thickness of the photogenerator layer depends on a number of factors, including the thicknesses of the other layers and the amount of photogenerator material contained in the photogenerating layers. Accordingly, this layer can be of a thickness of, for example, from about 0.05 micron to about 10 microns, and more specifically, from about 0.25 micron to about 2 microns, and wherein, for example, the photogenerator component is present in an amount of from about 30 to about 75 percent by volume. The maximum thickness of this layer in embodiments is dependent primarily upon factors, such as the desired photosensitivity, the achievement of certain electrical properties, the amount of pigment dispersion, and mechanical considerations. The photogenerating layer binder resin present in various suitable amounts, for example from about 1 to about 50, and more specifically, from about 1 to about 10 weight percent, may be selected from a number of known polymers such as poly(vinyl butyral), poly(vinyl carbazole), polyesters, polycarbonates, poly(vinyl chloride), polyacrylates and methacrylates, copolymers of vinyl chloride and vinyl acetate, phenolic resins, polyurethanes, poly(vinyl alcohol), polyacrylonitrile, polystyrene, and the like. It is desirable to select a coating solvent that does not substantially disturb or adversely affect the other previously coated layers of the device. Examples of solvents that can be selected for use as coating solvents for the photogenerator layers are ketones, alcohols, aromatic hydrocarbons, halogenated aliphatic hydrocarbons, ethers, amines, amides, esters, and the like. Specific examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The provision of the photogenerator layer in embodiments of the present invention can be accomplished with spray, dip or wire-bar methods such that the final dry thickness of the photogenerator layer is, for example, from about 0.01 to about 30 microns, and more specifically, from about 0.1 to about 15 microns after being dried at, for example, about 40° C. to about 150° C. for about 15 to about 90 minutes.

Illustrative examples of polymeric binder materials that can be selected for the photogenerator layer are as indicated herein, and include those polymers as disclosed in U.S. Pat. No. 3,121,006, the disclosure of which is totally incorporated herein by reference. In general, the effective amount of polymer binder that is utilized in the photogenerator layer ranges from about 0 to about 95 percent by weight, and preferably from about 25 to about 60 percent by weight of the photogenerator layer.

As optional adhesive layers usually formed to be in contact with the hole blocking layer and the photogenerator layer, there can be selected various known substances inclusive of polyesters, polyamides, poly(vinyl butyral), poly (vinyl alcohol), polyurethane and polyacrylonitrile. This layer is, for example, of a thickness of from about 0.001 micron to about 1 micron. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present invention further desirable imaging member electrical and optical properties.

The charge transport layer, which generally is of a thickness of from about 5 microns to about 75 microns, and more specifically, of a thickness of from about 10 microns to about 40 microns, can be comprised of known charge transporting materials and to be later developed materials, and which layer, for example, can be comprised of the polymeric solid acid illustrated herein, and molecules of the following formula

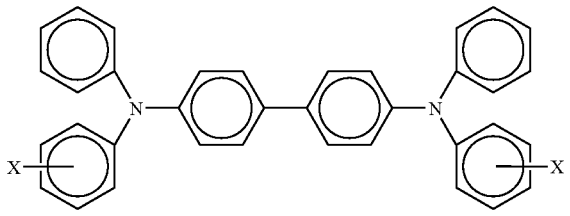

dispersed in a highly insulating and transparent polymer binder, wherein X is an alkyl group, an alkoxy, a halogen, or mixtures thereof, and especially those substituents selected from the group consisting of Cl and $CH_3$.

Examples of specific aryl amines are N,N'-diphenyl-N,N'-bis(alkylphenyl)-1,1-biphenyl-4,4'-diamine wherein alkyl is selected from the group consisting of methyl, ethyl, propyl, butyl, hexyl, and the like; and N,N'-diphenyl-N,N'-bis(halophenyl)-1,1'-biphenyl-4,4'-diamine wherein the halo substituent is preferably a chloro substituent. Other known charge transport layer molecules can be selected, reference for example, U.S. Pat. Nos. 4,921,773 and 4,464,450, the disclosures of which are totally incorporated herein by reference.

Examples of the binder materials for the transport layer include components, such as those described in U.S. Pat. No. 3,121,006, the disclosure of which is totally incorporated herein by reference. Specific examples of polymer binder materials include polycarbonates, acrylate polymers, vinyl polymers, cellulose polymers, polyesters, polysiloxanes, polyamides, polyurethanes, poly(cyclo olefins), and epoxies as well as block, random or alternating copolymers thereof. Preferred electrically inactive binders are comprised of polycarbonate resins with a molecular weight of from about 20,000 to about 100,000 or with a molecular weight $M_w$ of from about 50,000 to about 100,000 being particularly preferred. Generally, the transport layer contains from about 10 to about 75 percent by weight of the charge transport component, and more specifically, from about 35 percent to about 50 percent of this material.

Also included within the scope of the present invention are methods of imaging and printing with the photoresponsive devices illustrated herein. These methods generally involve the formation of an electrostatic latent image on the imaging member, followed by developing the image with a toner composition comprised, for example, of thermoplastic resin, colorant, such as pigment, charge additive, and surface additives, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the same steps with the exception that the exposure step can be accomplished with a laser device or image bar.

The following Examples are being submitted to illustrate embodiments of the present invention. These Examples are intended to be illustrative only and are not intended to limit the scope of the present invention. Also, parts and percentages are by weight unless otherwise indicated. Comparative Examples and data are also provided.

EXAMPLE I

An electrophotographic imaging member web stock was prepared by providing a 0.02 micrometer thick titanium layer coated on a substrate of a biaxially oriented polyethylene naphthalate substrate (KADALEX™, available from ICI Americas, Inc.) having a thickness of 3.5 mils (89 micrometers). The titanized KADALEX™ substrate was coated with a blocking layer solution containing a mixture of 10 grams of gamma aminopropyltriethoxy silane, 10.1 grams of distilled water, 3 grams of acetic acid, 684.8 grams of 200 proof denatured alcohol and 200 grams of heptane. This wet coating layer was then allowed to dry for 5 minutes at 135° C. in a forced air oven to remove the solvents from the coating and effect the formation of a crosslinked silane blocking layer. The resulting blocking layer was of an average dry thickness of 0.05 micrometer as measured with an ellipsometer.

An adhesive interface layer was then deposited by applying to the blocking layer a wet coating solution containing 5 percent by weight of the polyester MOR-ESTER 49,000®, having a weight average molecular weight of about 70,000, available from Morton International, and based on the total weight of the solution in a 70:30 volume ratio mixture of tetrahydrofuran/cyclohexanone. The adhesive interface layer was allowed to dry for 5 minutes at 135° C. in a forced air oven. The resulting adhesive interface layer had a dry thickness of 0.065 micrometer.

A slurry coating solution of 40 percent by volume hydroxygallium phthalocyanine and 60 percent by volume poly(4,4'-diphenyl-1,1'-cyclohexane carbonate (PCZ-200™, available from Mitsubishi Gas Chemical) dispersed in tetrahydrofuran was extrusion coated onto this adhesive interface layer. The coated member was dried at 135° C. in a forced air oven to form a dry photogenerating layer having a thickness of 0.4 micrometer.

EXAMPLE II

Two of the photogenerator layers of Example I were coated with transport layers (HTMI) of 45 weight percent (based on the total solids) of the hole transport compound N,N'-diphenyl-N,N'-bis(3-methyl-phenyl)-(1,1'-biphenyl)-4,4'-diamine

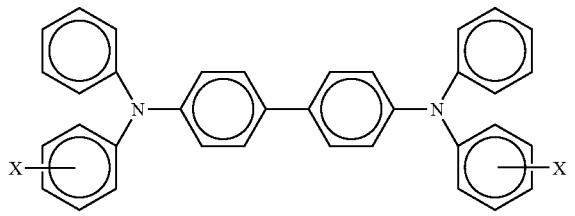

wherein X is a methyl group attached to the meta position, the weight percent illustrated herein (based on total solids) polycarbonate resin MAKROLON® 5705, a poly(4,4'-isopropylidene-diphenylene)carbonate available from Farbenfabricken Bayer A.G., the weight percent illustrated herein of the antioxidant IRGANOX 1010®, pentaerythritol tetrakis(3-(3,5-di-tert-butyl-4-hydroxyphenyl)propionate) available from Ciba Spezialitatenchemie AG, and 0 (zero) and 1 weight percent UCARMAG 527® of the formula

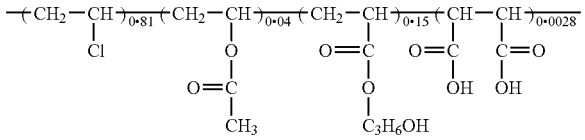

available from Union Carbide, applied as a solution in methylene chloride 17 weight percent. The coated devices were heated in an oven maintained at from about 40° C. to about 100° C. for over 30 minutes to form a charge transport layer having a thickness of 25 micrometers.

TABLE 1

| DEVICE # | MAKROLON WT % | HTM1 WT % | IRGANOX 1010 ® | UCARMAG 527 ® |
|---|---|---|---|---|
| 1 | 48% | 45% | 7% | 0% |
| 2 | 47% | 45% | 7% | 1% |

EXAMPLE III

The flexible photoreceptor sheets prepared as described in Example II were tested for their xerographic sensitivity and cyclic stability in a scanner. In the scanner, each photoreceptor sheet to be evaluated was mounted on a cylindrical aluminum drum substrate which was rotated on a shaft. The devices were charged by a corotron mounted along the periphery of the drum. The surface potential was measured as a function of time by capacitively coupled voltage probes placed at different locations around the shaft. The probes were calibrated by applying known potentials to the drum substrate. Each photoreceptor sheet on the drum was exposed to a light source located at a position near the drum downstream from the corotron. As the drum was rotated, the initial (pre-exposure) charging potential was measured by voltage probe 1. Further rotation lead to an exposure station, where the photoreceptor device was exposed to monochromatic radiation of a known intensity. The devices were erased by a light source located at a position upstream of charging. The measurements illustrated in Table 2 included the charging of each photoconductor device in a constant current or voltage mode. The devices were charged to a negative polarity corona. The surface potential after exposure was measured by a second voltage probe. The devices were finally exposed to an erase lamp of appropriate intensity and any residual potential was measured by a third voltage probe. The process was repeated with the magnitude of the exposure automatically changed during the next cycle. The photodischarge characteristics were obtained by plotting the potentials at voltage probe 2 as a function of light exposure. The charge acceptance and dark decay were also measured in the scanner. Table 2 indicates the background potentials of probe 2 at 10 ergs/cm$^2$, the exposure energy to discharge the photoreceptors to half of their initial potentials $V_0$, and the dark decay for one second at an initial potential of about 900V.

TABLE 2

| DEVICE # | POTENTIAL [V] AT 10 ERGS/ $CM^2$ | RESIDUAL POTENTIAL AFTER ERASE [V] | EXPOSURE ENERGY FOR V0/2 [ERGS/ $CM^2$] | 1S DARK DECAY [V/S] @ V = 900 V |
|---|---|---|---|---|
| 1 | 84 | 58 | 1.16 | 93 |
| 2 | 26 | 15 | 1.07 | 86 |

Table 3 provides the same parameters as in Table 2 for the same devices that have been electrically fatigued for 10,000 cycles.

TABLE 3

| DEVICE # | POTENTIAL [V] AT 10 ERGS/ $CM^2$ @10K CYCLES | RESIDUAL POTENTIAL AFTER ERASE [V] @ 10K CYCLES | EXPOSURE ENERGY FOR V0/2 [ERGS/$CM^2$] @ 10K CYCLES | 1S DARK DECAY @ V = 900 V AND 10K CYCLES |
|---|---|---|---|---|
| 1 | 91 | 52 | 1.27 | 76 |
| 2 | 16 | 8 | 1.08 | 84 |

Device 2 doped with UCARMAG 527® had a lower background voltage, excellent residual voltage, and improved stability in discharge characteristics, and the dark decay was not detrimentally affected.

EXAMPLE IV

Four of the photogenerator layers of Example I were coated with transport layers of 45 weight percent (based on total solids) of the hole transport compound N,N-di-(3,4-dimethylphenyl)-4-biphenylamine

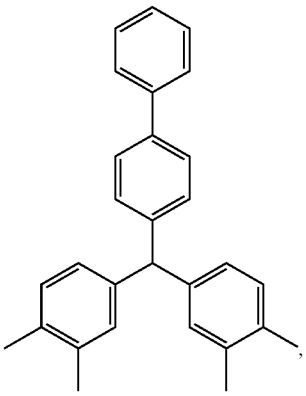

X (as illustrated in Table 4) weight percent (based on total solids) of the polycarbonate resin MAKROLON® 5705, a poly(4,4'-isopropylidene-diphenylene) carbonate available from Farbenfabricken Bayer A.G., Y weight percent of the antioxidant IRGANOX 1010®, pentaerythritol tetrakis(3-(3,5-di-tert-butyl-4-hydroxyphenyl)propionate) available from Ciba Spezialitatenchemie AG, and Z weight percent of UCARMAG 527® available from Union Carbide, applied as a solution in methylene chloride at 17 weight percent. The coated devices were heated in an oven maintained at from about 40° C. to about 100° C. over 30 minutes to form a charge transport layer having a thickness of 25 micrometers. The composition of the four transport layers are shown in Table 4.

TABLE 4

| DEVICE # | MAKROLON WT % | HTM WT % | IRGANOX 1010 ® | UCARMAG 527 ® |
|---|---|---|---|---|
| 3 | 55% | 45% | 0 | 0 |
| 4 | 54% | 45% | 0 | 1% |
| 5 | 49% | 45% | 6% | 0 |
| 6 | 48% | 45% | 6% | 1% |

EXAMPLE V

The flexible photoreceptor sheets prepared as described in Example IV were tested in the same manner as in Example II for their xerographic sensitivity and cyclic stability in a scanner. Table 5 provides the background potentials of probe 2 at 10 ergs/$cm^2$, the exposure energy to discharge the photoreceptors to half of their initial potentials $V_0$, and the dark decay for one second at an initial potential of about 900V.

TABLE 5

| DEVICE # | POTENTIAL [V] AT 10 ERGS/ $CM^2$ | RESIDUAL POTENTIAL AFTER ERASE [V] | EXPOSURE ENERGY FOR $V_0/2$ [ERGS/ $CM^2$] | 1S DARK DECAY [V/S] @ V = 900 V |
|---|---|---|---|---|
| 3 | 102 | 79 | 1.13 | 108 |
| 4 | 90 | 66 | 1.09 | 94 |
| 5 | 170 | 151 | 1.02 | 90 |
| 6 | 82 | 57 | 1.1 | 84 |

Table 6 provides the same parameters as in Table 5 for the same devices that have been electrically fatigued for 10,000 cycles.

TABLE 6

| DEVICE # | POTENTIAL [V] AT 10 ERGS/ $CM^2$ @ 10K CYCLES | RESIDUAL POTENTIAL AFTER ERASE [V] AT 10K CYCLES | EXPOSURE ENERGY FOR $V_0/2$ [ERGS/$CM^2$] @ 10K CYCLES | 1S DARK DECAY @ V = 900 V AND 10K CYCLES |
|---|---|---|---|---|
| 3 | 133 | 87 | 1.3 | 160 |
| 4 | 14 | 3 | 1.14 | 84 |
| 5 | 250 | 199 | 1.45 | 52 |
| 6 | 17 | 4 | 1.14 | 78 |

Devices 4 and 6 that contained UCARMAG 527® possessed lower background voltages, excellent residual voltage, and excellent stability discharge characteristics. The dark decay was not detrimentally affected.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

What is claimed is:

1. A photoconductive imaging member comprised of a photogenerating layer and a charge transport layer, and wherein the charge transport layer contains a polymeric solid acid, and wherein said polymeric acid is of the formula

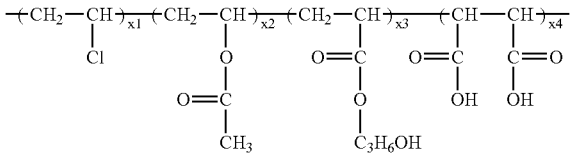

wherein $x_1$, $x_2$, $x_3$ and $x_4$ represent the molar percentage of each component in the polymer, and wherein the sum of $x_1$, $x_2$, $x_3$ and $x_4$is equal to 1.

2. A photoconductive imaging member in accordance with claim 1 and wherein said polymeric solid acid is a copolymer present in an amount of from about 0.0001 to about 20 percent by weight.

3. A photoconductive imaging member in accordance with claim 1 and wherein said polymeric acid is a copolymer present in an amount of from about 0.01 to about 20 percent by weight.

4. A photoconductive imaging member in accordance with claim 1 and wherein said polymeric acid is present in an amount of from about 0.04 to about 10 percent by weight.

5. A photoconductive imaging member in accordance with claim 1 and wherein said polymeric acid is present in an amount of from about 0.1 to about 5 percent by weight.

6. A photoconductive imaging member in accordance with claim 1 wherein said polymeric acid possesses a weight average molecular weight of from about 500 to about 100,000.

7. A photoconductive imaging member in accordance with claim 1 wherein said polymeric acid possesses a weight average molecular weight of from about 1,000 to about 50,000.

8. A photoconductive imaging member in accordance with claim 1 wherein said polymeric acid is a copolymer that possesses a number average molecular weight of from about 300 to about 90,000.

9. A photoconductive imaging member in accordance with claim 1 wherein said polymeric acid is a copolymer that possesses a number average molecular weight of from about 800 to about 40,000.

10. A photoconductive imaging member in accordance with claim 1 wherein said polymeric acid possesses a weight average molecular weight of from about 1,000 to about 50,000 and a number average molecular weight of form about 800 to about 40,000.

11. A photoconductive imaging member in accordance with claim 1 wherein said polymeric acid is of the formula

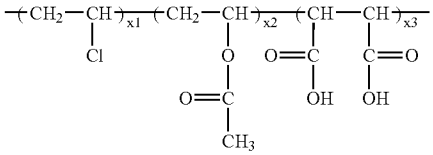

wherein $x_1$, $x_2$, and $x_3$ represent the molar percentage of each component in the polymer, and the sum of $x_1$, $x_2$, and $x_3$ is equal to 1.

12. An imaging member in accordance with claim 11 wherein $x_1$, $x_2$, and $x_3$ are each from about 0.1 to about 0.9.

13. An imaging member in accordance with claim 11 wherein $x_1$, $x_2$, and $x_3$ are each from about 0.05 to about 0.7.

14. An imaging member in accordance with claim 11 wherein $x_1$ and $x_2$ are each from about 0.1 to about 0.8.

15. A photoconductive imaging member in accordance with claim 1 wherein said polymeric acid is a copolymer of poly(ethylene-co-acrylic acid), poly(ethylene-co-methacrylic acid), poly(1,6-hexanedio/neopentyl glycol-alt-adipic acid), poly(3-hydroxybutyric acid), poly(3-hydroxybutyric-co-3-hydroxyvaleic acid), poly(4-hydroxy benzoic acid-co-ethylene terephthalate), poly(methyl vinyl ether-alt-maleic acid), poly(styrene-co-maleic acid) ester, poly(vinyl chloride-co-vinyl acetate-co-maleic acid) (VMCH®), or poly(vinyl chloride-co-vinyl acetate-co-2-hydroxypropyl acrylate-co-maleic acid).

16. A photoconductive imaging member in accordance with claim 1 wherein the member further contains a hole blocking layer and an optional adhesive layer.

17. An imaging member in accordance with claim 16 wherein said hole blocking layer is a tetrakis[methylene(3,5-di-tert-butyl-4-hydroxy hydrocinnamate)]methane.

18. An imaging member in accordance with claim 16 wherein the hole blocking layer is a hydrolyzed amino silane.

19. An imaging member in accordance with claim 16 wherein said hole blocking layer contains 4,4'-sulfonyldiphenol, 4,4'-isopropylidenediphenol, 4,4'-ethylidenebisphenol, bis(4-hydroxyphenyl)methane, 4,4'-(1,3-phenylenediisopropylidene) bisphenol, 4,4'-(1,4-phenylenediisopropylidene) bisphenol, 4,4'-cyclohexylidenebisphenol, 4,4'-(hexafluoroisopropylidene) diphenol, 1,3-benzenediol, or 1,4-benzenediol.

20. An imaging member in accordance with claim 16 wherein said hole blocking layer contains from about 1 to about 99 weight percent of a first phenolic resin and from about 99 to about 1 weight percent of a second phenolic resin, and wherein the total thereof is about 100 percent.

21. An imaging member in accordance with claim 16 wherein said hole blocking layer is of a thickness of about 0.01 to about 10 microns.

22. A photoconductive imaging member in accordance with claim 1 comprised in the following sequence of a supporting substrate, a hole blocking layer, an optional adhesive layer, said photogenerating layer, and said charge transport layer, and wherein the charge transport layer is a hole transport layer.

23. A photoconductive imaging member in accordance with claim 22 wherein the adhesive layer is present and is comprised of a polyester with an $M_w$ of about 45,000 to about 75,000, and an $M_n$ of from about 30,000 about 40,000.

24. A photoconductive imaging member in accordance with claim 1 further containing a supporting substrate comprised of a conductive metal substrate of aluminum, aluminized polyethylene terephthalate or titanized polyethylene terephthalate.

25. A photoconductive imaging member in accordance with claim 1 wherein said photogenerator layer is of a thickness of from about 0.05 to about 10 microns, and wherein said transport layer is of a thickness of from about 20 to about 75 microns.

26. A photoconductive imaging member in accordance with claim 1 wherein said photogenerating layer is comprised of a photogenerating pigment or photogenerating pigments dispersed in a resinous binder, and wherein said pigment or pigments are present in an amount of from about 5 percent by weight to about 95 percent by weight, and optionally wherein the resinous hinder is selected from the group comprised of vinyl chloride/vinyl acetate copolymers, polyesters, polyvinyl butyrals, polycarbonates, polystyrene-b-polyvinyl pyridine, and polyvinyl formats.

27. A photoconductive imaging member in accordance with claim 1 wherein the charge transport layer comprises hole transport aryl amines, and which aryl amines are of the formula

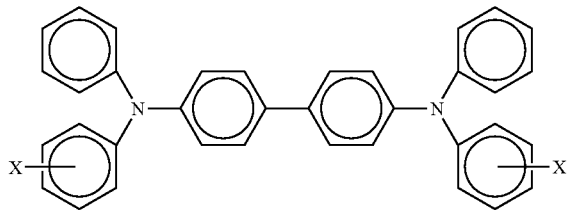

wherein X is selected from the group consisting of alkyl, alkoxy, and halogen.

28. An imaging member in accordance with claim 26 wherein the awl amine is N,N'-diphenyl-N,N-bis(3-methyl phenyl)-1,1'-biphenyl-4,4'-diamine.

29. A photoconductive imaging member in accordance with claim 1 wherein the photogenerating layer is comprised of metal phthalocyanines, or metal free phthalocyanines.

30. A photoconductive imaging member in accordance with claim 1 wherein the photogenerating layer is comprised of titanyl phthalocyanines, perylenes, or hydroxygallium phthalocyanines.

31. A photoconductive imaging member in accordance with claim 1 wherein the photogenerating layer is comprised of Type V hydroxygallium phthalocyanine.

32. A method which comprises generating an image on the imaging member of claim 1, developing the latent image, and transferring the developed image to a suitable substrate.

33. An imaging member in accordance with claim 1 wherein x is about 0.81, $x_2$ is about 0.04, x3 is about 015, and $x_4$ is about 0.0028.

34. A photoconductive imaging member in accordance with claim 1 further including a rigid substrate.

35. A photoconductive imaging member in accordance with claim 1 further including a supporting drum substrate.

36. A photoconductive imaging member in accordance with claim 1 further including a supporting web substrate.

37. An imaging member in accordance with claim 1 wherein $x_1$ is from about 0.1 to about 0.8, $x_2$ is from about 0.05 to about 0.3, $x_3$ is from about 0.1 to about 0.4, and y is from about 0.01 to about 0.4 providing that the sum of $x_1$, $x_2$, $x_3$, and $x_4$ is equal to 1.

38. An imaging member in accordance with claim 1 wherein said polymeric acid is of the formula

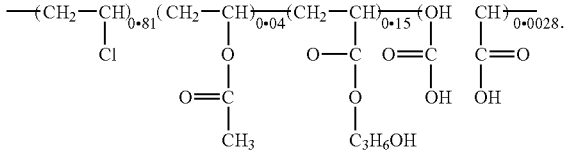

39. A member comprised of a supporting substrate a photogenerating layer, and a charge transport layer, and wherein the charge transport layer contains a copolymeric solid acid, and wherein said copolymeric solid acid is of the formula

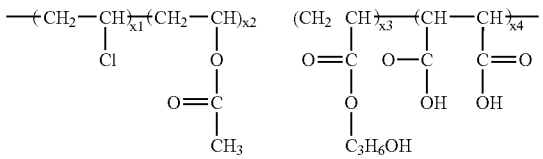

wherein $x_1$, $x_2$, $x_3$ and $x_4$ represent the molar percentage of each component in the polymer, and wherein the sum of $x_1$, $x_2$, $x_3$ and $x_4$ is equal to 1.

40. A photoconductive imaging member comprised of a supporting substrate, an optional hole blocking layer, a photogenerating layer, and a charge transport layer, and wherein the charge transport layer contains a polymeric solid acid of poly(ethylene-co-acrylic acid), poly(ethylene-co-methacrylic acid), poly(1,6-hexanedio/neopentyl glycol-alt-adipic acid), poly(3-hydroxybutyric acid), poly(3-hydroxybutyric-co-3-hydroxyvaleic acid), poly(4-hydroxy benzoic acid-co-ethylene terephthalate), poly(methyl vinyl ether-alt-maleic acid), poly(styrene-co-maleic acid) ester, poly(vinyl chloride-co-vinyl acetate-co-maleic acid), or poly(vinyl chloride-co-vinyl acetate-co-2-hydroxypropyl acrylate-co-maleic acid).

41. An imaging member in accordance with claim 40 wherein said blocking layer is present, and wherein said member further includes an adhesive layer.

42. A photoconductive imaging member comprised in sequence of a supporting substrate, a photogenerating layer, and thereover a charge transport layer, and wherein the transport layer contains a polymeric solid acid of the formula

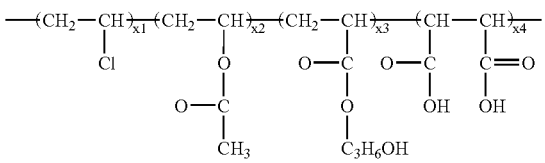

wherein $x_1$, $x_2$, $x_3$ and $x_4$ represent the molar percentage of each component in the polymer, and wherein the sum of $x_1$, $x_2$, $x_3$ and $x_4$ is equal to about 1.

* * * * *